United States Patent [19]

Lyasko

[11] Patent Number: 4,458,248

[45] Date of Patent: Jul. 3, 1984

[54] PARAMETRIC ANTENNA

[75] Inventor: Arie Lyasko, Tel-Aviv, Israel

[73] Assignee: Haramco Research, Inc., Litchfield, Conn.

[21] Appl. No.: 371,810

[22] Filed: Apr. 26, 1982

[51] Int. Cl.[3] ..... H01Q 1/04; H01Q 7/08

[52] U.S. Cl. ..... 343/719; 343/788; 343/895; 455/40; 455/276

[58] Field of Search ..... 343/701, 719, 787, 788, 343/895; 455/40, 41, 276, 280, 289, 291

[56] References Cited

U.S. PATENT DOCUMENTS

| | | | |
|---|---|---|---|
| Re. 26,196 | 4/1967 | Boyer | 343/742 |
| 1,315,862 | 9/1919 | Rogers | 343/719 |
| 1,372,658 | 3/1921 | Jones | 343/719 |
| 2,021,557 | 11/1935 | Kolarz | 343/742 |
| 2,366,195 | 1/1945 | Kandoian | 343/742 |
| 2,617,033 | 11/1952 | Posthumus | 343/741 |
| 3,811,129 | 5/1974 | Holst | 343/844 |
| 3,867,710 | 2/1975 | Busignies | 343/719 |
| 4,184,163 | 1/1980 | Woodward | 343/742 |
| 4,312,003 | 1/1982 | Robbins | 343/788 |

OTHER PUBLICATIONS

Wheeler, Fundamental Relations in the Design of a VLF Transmitting Antenna, IRE Transactions on Antennas and Propagation, Jan. 1958, p. 120 ff.

Wheeler, Small Antennas, IEEE Transactions on Antennas and Propagation, v. AP-23, No. 4, Jul. 1975, p. 462 ff.

Wheeler, The Radiansphere Around a Small Antenna, Proc. of IRE, Aug. 1959, p. 1325 ff.

Charvat, Ferrite Antenna in Magion Satellite for Frequency Range of 0.1 through 16 kHz, Slaboproudy Obzor, v. 41, n. 4, 1980, p. 157 ff (with translation).

*Primary Examiner*—Eli Lieberman

*Attorney, Agent, or Firm*—Lee C. Robinson, Jr.

[57] ABSTRACT

A communication system suitable for use at a broad range of radio frequencies utilizes a parametric magnetic dipole antenna. This antenna incudes an elongated core, favorably formed of a hexagonal bundle of ferrite rods, each composed of a stack of apertured ferrite cups, with the apertures defining axial bores extending through the respective rods. A helical antenna winding of n turns extends around a central part of the bundle of rods, and a control winding extends through the axial bores to carry a control current, which generates a magnetic field generally orthogonal to that of the helical antenna winding. The phase of the control current is locked to that of the frequency to which the antenna winding is tuned.

15 Claims, 10 Drawing Figures

FIG. 1
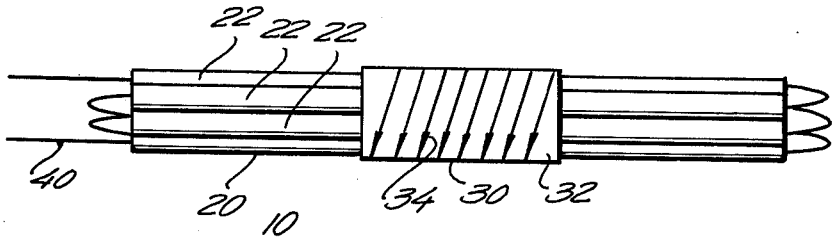
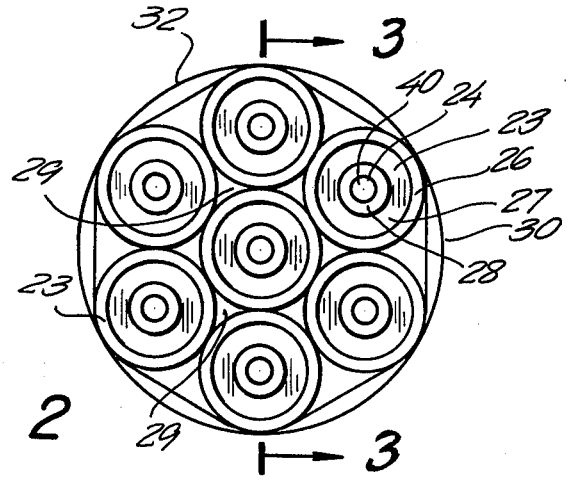
FIG. 2
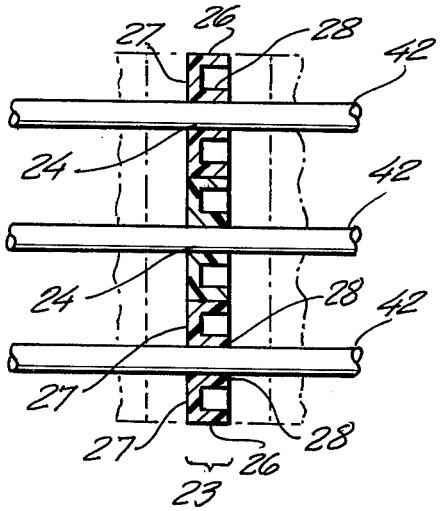
FIG. 3

PARAMETRIC ANTENNA

BACKGROUND OF THE INVENTION

This invention relates to apparatus for communicating by propagation of electromagnetic waves, and is broadly directed to apparatus for transmitting and/or receiving electromagnetic radiation over a broad range of radio frequencies. The invention is more particularly directed to a communications system utilizing a parametric magnetic dipole antenna which can be suitably mounted on platforms in a wide variety of environments, including on land, at sea, beneath the sea surface, a loft, in earth orbit, and in space.

At present, radio communication with divers or undersea vessels has been severly hampered by the difficulty of propagating radio waves in seawater.

Seawater, because of its relatively high conductivity, attenuates radio waves rather quickly. At radio frequencies useful in communication, radio waves are completely attenuated in less than about one wavelength. Generally, only so-called near-field propagation is possible—that is, a submerged vessel or diver cannot be more than about one radianlength (i.e.,$\lambda/2\pi$) of the radio wave beneath the sea surface and still receive a useful amount of signal. Conseqently, for medium frequencies, a conventional submerged radio antenna needs to be within about one meter of the sea surface.

Recent attempts at subsea communication have involved use of the very low frequency (VLF) and extreme low frequency (ELF) radio spectra, i.e., those frequencies between 3 KHz and 30 KHz, and below 3 KHz, respectively. Because ELF and VLF radio waves have long wavelengths, the radio waves penetrate seawater to at least a useful distance. For example, a radio wave with a frequency of 10 KHz has a radianlength of about five kilometers, and, if that frequency is used, it is theoretically possible to communicate with a submerged vessel far below the surface.

Unfortunately, an electric dipole antenna for a frequency of 10 KHz, cut to one-half wavelength, would have an unwieldy length of about 15 kilometers (i.e., nine miles), thereby making the antenna impracticable for use on a any vessel. A long wire antenna could be cut to a somewhat shorter length, but would still need to be at least several thousand meters long to have an acceptably high transmission/reception power.

Consequently, a practical, small antenna useful at frequencies including the very low and extremely low frequencies has long been sought.

OBJECTS AND SUMMARY OF THE INVENTION

It is a desired object of this invention to provide a communication system suitable for use in a multitude of environments, including under water, without requiring a cumbersome long antenna.

It is a more specific object of this invention to provide a communications system incorporating an antenna that can radiate or receive radio waves efficiently even in the very low and extreme low frequency bands.

It is another object of this invention to provide a small antenna that is an efficient radiator at low frequencies, enabling construction of compact transmitter and/or receiver apparatus suitable to be carried, for example, by a diver or a submerged vessel, or on an orbiting satellite.

According to several preferred embodiments of this invention, a parametric magnetic dipole is provided having an elongated core, for example, comprised of a plurality of ferrite rods each having an axial bore extending therethrough. A helical antenna winding is coiled circumferentially over a central portion of the antenna core, preferably occupying approximately the middle third thereof. This helical winding, in a transmitter antenna, generates a magnetic field substantially in the axial direction with respect to the antenna core. Of course, in a corresponding receiver antenna, this winding is sensitive to changes in magnetic flux along the axis of the core.

This antenna also recognizes the fact that the magnetic permeability $\mu$ of the core is not an absolute constant, but varies somewhat with changes in the exciting magnetizing field. With this in mind, means are provided for generating a control field in the magnetic antenna core orthogonal to the field of the antenna winding, i.e., perpendicular to the axis of the core. The control field is varied in phase with the radio wave that is transmitted or received in order to modulate the permeability $\mu$ at the frequency of the radio wave.

The control field can be produced by conductors passing through axial bores in the magnetic core which conductors together form a control winding.

In a transmitter, the control winding is fed current at a desired carrier frequency while the helical winding is supplied with an exciter current, also at the carrier frequency, but on which an information signal has been modulated.

In a corresponding receiver, a tunable oscillator furnishes a control current to the control winding, and the helical winding is connected to a detector and also to a phase comparator of a phase-locked loop that includes the tunable oscillator. During tuning or hunting for a received signal, the tunable oscillator is free running. However, as soon as the receiver begins to pick up a radio wave with a frequency within the capture range of the phase locked loop, the oscillator locks the phase of the control current to that of the received radio wave.

The antenna core can favorably be formed as a hexagonal bundle of rods, with each rod being comprised of a stack of toroidal members, for example, ferrite cups having an apertured end wall.

These and many other desirable objects, features, and advantages of this invention will become more fully apparent from the ensuing description of several preferred embodiments thereof, when considered in connection with the accompanying drawings.

BRIEF DESCRIPTION OF THE DRAWINGS

FIGS. 1 and 2 are a side elevation and an end view, respectively, of a parametric magnetic dipole antenna according to one embodiment of this invention.

FIG. 3 is a partial sectional view taken along the line 3—3 of FIG. 2.

DETAILED DESCRIPTION OF SEVERAL PREFERRED EMBODIMENTS

Figure 8:
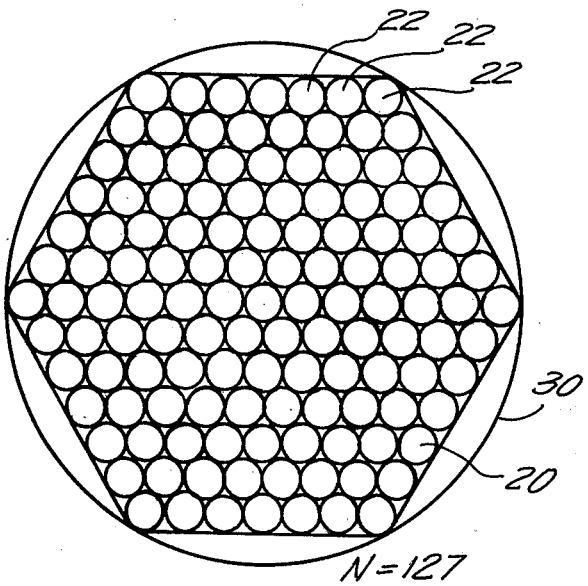
FIGS. 4–8 are end views of antennas according to other possible embodiments of this invention.
Figure 6:
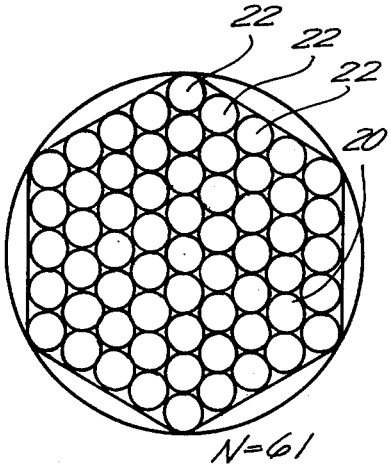
Figure 7:
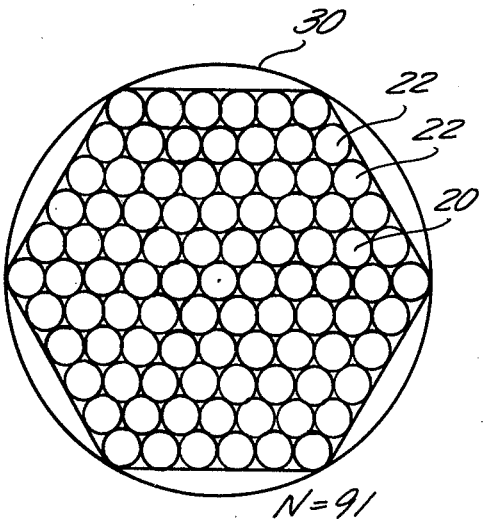
Figure 5:
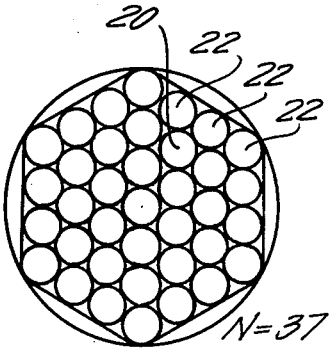
Figure 4:
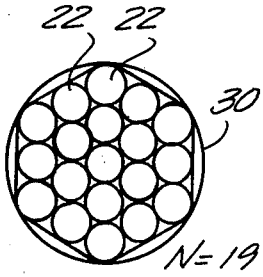

With reference to the drawings and initially to FIGS. 1–3 thereof, a parametric magnetic dipole antenna 10 is provided having a usable frequency range of about 5 KHz to about 5 MHz, that is, over at least the very-low-frequency, low-frequency, and medium-frequency bands. This antenna can also be favorably used at the so-called extreme low frequencies, that is, those frequencies below about 3 KHz. Consequently, this antenna 10 can be incorporated into a communications system for communicating by radio with a diver or with a subsea vessel.

In the embodiment of the antenna 10 shown in FIGS. 1–3, an elongated magnetic core 20 is formed of a hexagonal bundle of rods 22 of magnetic material. In this case, a central rod 22 is surrounded by a closely packed arrangement of six peripheral rods 22 so that a total of N=7 rods are used.

Each of the rods 22 is formed of a stack of toroidal members 23, and, in this embodiment, these members are generally cylindrical ferrite cups. A central bore or passageway 24 extends throughout each such stack of cups 23.

Each cup is formed of an outer cylindrical wall 26, an annular bottom 27, and an inner cylindrical wall 28 surrounding the passageway 24.

These cups are arranged so that the outer walls 26 of the cups 23 of different respective rods are in contact with each other, and so that the rods define generally triangular voids 29 which also run the length of the core 20. If the antenna 10 is used as a transmitting antenna, forced air or cooling fluid can be circulated through the voids 29 for removal of waste heat generated in the core 20.

A helical antenna coil or winding 30 is disposed circumferentially about the core assembly 20 and occupies generally a central quarter to a central third of the length of the core assembly. Preferably, the helical winding 30 extends in the axial direction of the core assembly from a midplane thereof a distance less than halfway towards each end of the core assembly 20. A cylindrical coil form 32 is disposed on the hexagonal core assembly 20 and a coiled flat wire conductor 34 is wound on the form 32. The conductor 34 can consist of, for example, n=30 turns, and each turn is generally inclined at a slight angle with respect to the core assembly 20.

A control coil 40 is disposed within the core assembly 20 to generate a control magnetic field in a direction generally orthogonal to that of the antenna winding 30. To this end, conductive pins 42 pass through the passageways 24 and are used both for support of the cups 23 and to carry a control current $I_c$. The ends of these pins 42 can be favorably connected to carry current, at a given instant, as shown in FIG. 2, in which a dot indicates current in the direction out of the drawing while a cross indicates current in the direction into the drawing. In this embodiment, an odd number of rods 22 and associated conductive pins 42 are employed, and the central pin 42 is not connected in the control coil 40.

An electro-insulating material is provided between the pins 42 and the associated passageway 24, preferably by coating the pins 42 or coating the inner side of each of the cylindrical walls 28.

The cups 23 are favorably formed of N30 type ferrite. In such material, a control current $I_c$ of 13 ma can be employed to generate a magnetic flux density $H_c$ of 0.163 Oerstads.

The abutting surfaces of the cups 23 of each core rod 22 should be ground as flat as possible to ensure good magnetic contact therebetween, especially if the antenna 10 is to be used at frequencies higher than 30 Khz.

The core assembly 20 constructed as described hereinabove forms a magnetic circuit which is uniform in its magnetic conductivity in the longitudinal direction thereof. Thus, even if there is an error in the axial position of the antenna winding 30, there will be no more than about 5% deviation in the solenoid inductance of the winding 30.

However, in order to achieve maximum emissive power from the antenna 10, the winding 30 should be placed nearly exactly in the middle, that is, centered on the central plane of the core assembly 20. The length of the core assembly 20 should be at least equal to two diameters of the core assembly 20 plus double the axial lenght of the antenna coil 30.

The control current $I_c$ applied to the control winding 40 generates a magnetic field orthogonal to the field of the winding 30 and thus fluctuates the magnetic permeability $\mu$ and, thereby, controls the value of the effective conductance of the antenna 10 and the emissive resistance $R_E$ thereof in phase with the radio frequency signal. The magnetic control field $H_c$ will be orthogonal to that of the winding 30, and will be completely contained within the core assembly 20.

The embodiment of the antenna shown in FIGS. 1–3 can be made quite small, for example, on the order of one meter in length, and can be incorporated into a low-frequency or very-low frequency raido carried by a deep sea diver.

Further embodiment having generally the same structure are shown in cross section in FIGS. 4–8. These antennas have core assemblies formed of N=19, N=37, N=61, N=91, and N=127 rods, respectively, each assembly being arranged in a generally hexagonal configuration to ensure close contact of the rods 22 of each core assembly. In general, the core assemblies of each of the foregoing embodiments comprises a bundle of $N_x$ core rods 22, where $$N_x = 1 + \sum_{n=1}^{x} 6n,$$

with x being a positive integer.

Figure 9:
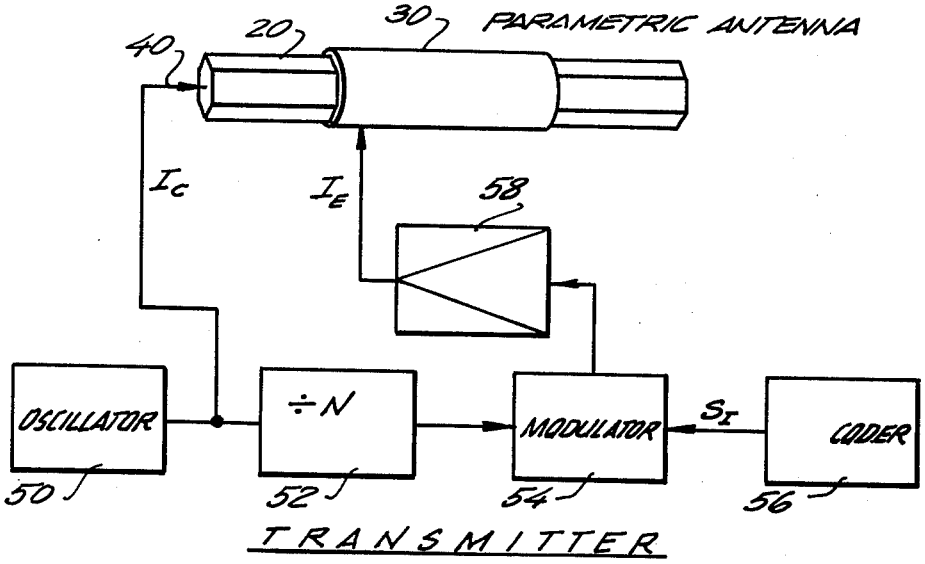
FIG. 9 is a schematic diagram of a transmitter according to the invention.

A transmitter assembly incorporating the parametric antenna 10 can be constructed generally as shown in FIG. 9. Here an oscillator 50 generates an oscillating signal to be applied as a control current $I_c$ to the control coil 40. This signal is also applied through a frequency divider 52 to a modulator 54 where a carrier, which is an exact subharmonic of the control signal $I_c$ is modulated by an information signals $S_i$ provided from an information source 66, which here can be a data encoder. This modulated signal is amplified in an RF amplifier 58 and then is applied as an excitation current $I_e$ to the antenna winding 30.

The frequency of the control current $I_c$ should be a harmonic of the carrier of the excitation current $I_E$, and thus should have an exact phase relationship therewith. Preferably, the frequency of the control current $I_c$ is the second or third harmonic of such carrier.

Figure 10:
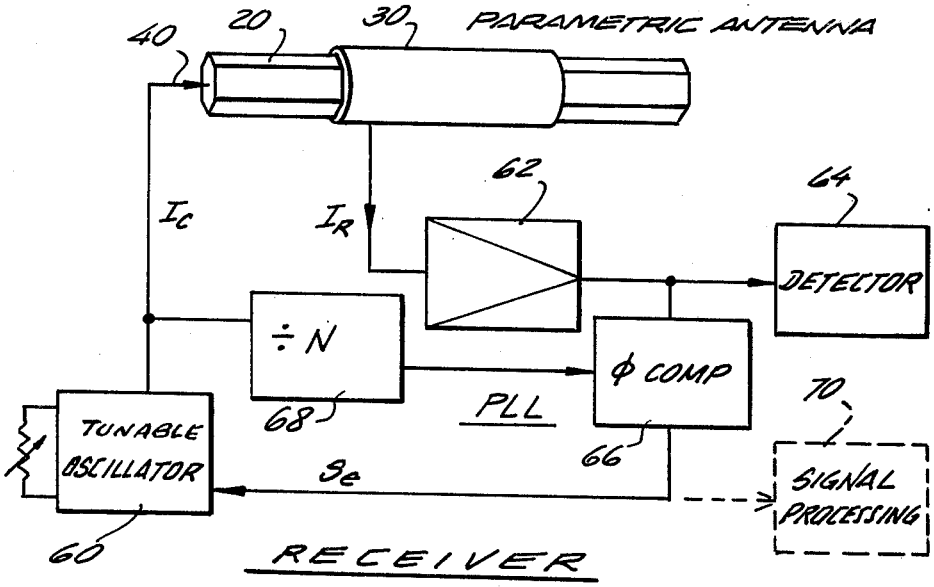
FIG. 10 is a schematic diagram of a receiver accordng to this invention.

A receiver according to this invention, including the parametric antenna 10, is shown in FIG. 10. Here a tunable oscillator 60 provides an oscillating output signal which is fed to the control coil 40 as the control current $I_c$. At the same time, a received current $I_R$ generated in the helical antenna winding 30 is applied through a radio frequency oscillator 62 to a detector 64 and also to one terminal of the phase comparator 66. The oscillating output from the tunable oscillator 60 is divided in a frequency divider 66 and a subharmonic thereof is then furnished to another input of the phase comparator 66. It should be appreciated that the oscillator 60, the divider 68 and the phase comparator 66 form a phase-locked loop. Thus, the phase comparator 66 provides an error signal $S_e$ to an input of the oscillator 60 to control its oscillating frequency and lock the phase of the oscillating output thereof to the phase of the received current $I_R$.

During tuning of the receiver, the tunable oscillator 60 can be free running while the receive frequency is manually tuned. However, as soon as the frequency of the received current $I_R$ is within the capture range of the phase-locked loop 60, 66, 68, the phase of the control current $I_c$ will be locked to the phase of the received current $I_R$.

In place of the detector 64, it is possible to derive the information signal carried on the received current $I_R$ by processing the error signal $S_e$ in a signal processing stage 70, as shown in ghost lines in FIG. 10.

It is preferred that the frequency divider 68 be a divide-by-two counter and that the oscillating frequency of the control current $I_c$ be the second harmonic of the carrier of the received signal as represented by the received current $I_R$.

The parametric magnetic dipole antennas embodying this invention are surprisingly good radiators at the rather low frequencies mentioned above, and the operating parameters for practical magnetic dipole antennas with an antenna winding of n=30 turns, for frequencies of 6 to 20 KHz.(i.e., an average frequency of 10.95 KHz), are set forth in the following table:

OPERATING PARAMETERS OF PRACTICAL MAGNETIC DIPOLE ANTENNAS WITH ANTENNA WINDING OF n = 30 TURNS, FOR FREQUENCIES OF 6–20 KHz (Average Frequency = 10.95 KHz)

| Number of Rods 22 | 7 | 19 | 37 | 60 | 91 | 127 |
|---|---|---|---|---|---|---|
| Overall Length of Core 20 | 107 cm | 179 cm | 249 cm | 321 cm | 392 cm | 464 cm |
| Overall Weight | 12.5 Kg | 56.2 Kg | 151.7 Kg | 217 Kg | 588 Kg | 970 Kg |
| Control Current $I_C$ | 10–50 A | 10–30 A | 10–30 A | 10–30 A | 10–30 A | 10–30 A |
| Emissive Resistance $R_E$ | 0.9–82Ω | 6Ω–600Ω | 20Ω–2K | 51Ω–6K | 100Ω–12K | 200Ω–24K |
| Average Emissive Resistance $\bar{R}_E$ | 8 | 60 | 200 | 553 | 11.1K | 2.2K |
| Average Exciting Current $\bar{I}_E$ | 22 A | 17 A | 17 A | 17 A | 17 A | 17 A |
| Average Voltage $\bar{V}_E$ | .19 KV | 1 KV | 1.2 KV | 9.9 KV | 21 KV | 42 KV |
| Average Emissive Power $\bar{P}_E$ | 1.5 KW | 8.8 KW | 33.6 KW | 90 KW | 193 KW | 400 KW |

The antennas set forth above are also correspondingly good receive antennas at these frequencies.

Antennas of the type illustrated in FIGS. 1–3 and 4 can find favorable use on subsea vessels, for deep sea diving, and as a beacon to mark the location of a sunken object, for example, a ship lost at sea. The antennas of the type illustrated in FIGS. 5 and 6 have favorable application in tactical navigation and communication systems, for example communication between an aircraft and a submarine at distances of 300 Km to 3000 Km. Antennas of the type illustrated in FIGS. 7 and 8 can be used at fixed radio sites for global communication, or can be mounted on a large vessel, such as an aircraft carrier.

It should be observed that none of these antennas is excessively large, the largest being less than five meters in length and weighing less than one metric ton.

These antennas can be used in a wide variety of mobile applications at a wide range of transmission power without the emission of dangerous levels of radiation.

Although certain preferred embodiments of this invention have been described hereinabove with reference to the drawings, it should be understood that many modifications and variations thereof will be apparent to those of ordinary skill without departure from the scope and spirit of the invention, which is to be determined from the appended claims.

What is claimed is:

1. A parametric antenna suitable for use at extreme low frequencies and comprising a plurality of elongated ferrite cores each having a central axis and an axial bore extending therethrough, the plurality of cores being bound together as a bundle with their axes thereof parallel;

a plurality of conductors each passing through the axial bore of a respective core to carry a control current; and a helical antenna winding disposed circumferentially about said bundle of cores.

2. A parametric antenna according to claim 1, wherein said cores are each formed of a stack of ferrite cups having a circumferential wall defining a space therewithin, and an end wall having a central aperture such that the central apertures in the ferrite cups of each said stack define said axial bore.

3. A parametric antenna according to claim 1, wherein said cores are each formed of a stack of ferrite toroidal members.

4. A parametric antenna according to claim 1, wherein said bundle is hexagonal in cross section.

5. A parametric antenna according to claim 4, wherein said plurality of cores consists of $N_x$ cores, where $$N_x = 1 + \sum_{n=1}^{x} 6n$$

and x is a positive integer.

6. A parametric antenna according to claim 1, wherein said helical antenna winding extends axially from a middle plane of said bundle a distance less than half way towards each end of the bundle.

7. A parametric antenna for use at extreme low frequencies, comprising a plurality of ferrite rods forming a bundle such that central axes of the rods are parallel, with each rod having an axial bore therethrough;

a plurality of conductors each passing through the axial bore of a respective rod to carry a control current; and a helical antenna winding circumferentially about said bundle of rods.

8. A parametric antenna comprising a plurality of ferrite rods forming a bundle such that central axes of the rods are parallel, with each rod having an axial bore therethrough;

a helical antenna winding circumferentially about said bundle of rods, and having an axis substantially in the axial direction of said bundle;

a plurality of n control conductors each passing through the axial bore of a respective rod to carry a control current; said control conductors forming a loop of substantially n turns having an axis substantially perpendicular to the axis of the antenna winding.

9. A parametric antenna according to claim 8, wherein said helical antenna winding extends axially from a middle plane of said bundle a distance less than half way toward each end of the bundle.

10. A transmitter for transmitting information modulated onto an electromagnetic carrier, comprising a parametric antenna formed of a plurality of elongated ferrite cores each having a central axis and an axial bore extending therethrough, the plurality of cores being bound together as a bundle with their axes disposed in parallel;

a plurality of control conductors each passing through the axial bore of a respective core to carry a control current; and a helical antenna winding disposed circumferentially about said bundle of cores; a source of information signals; a source of a carrier signal having a carrier frequency; modulator means modulating said information signals onto said carrier and applying a resulting excitation current to said helical antenna winding; and means applying a control current having said carrier frequency to said plurality of control conductors.

11. A receiver for receiving information modulated onto an electromagnetic carrier having a carrier frequency comprising a parametric antenna formed of a plurality of elongated cores of magnetic material each having a central axis and an axial bore extending therethrough, the plurality of cores being bound together as a bundle with their axes thereof parallel;

a plurality of conductors each passing through the axial bore of a respective core to carry a control current; and a helical antenna winding disposed circumferentially about said bundle of cores;

a tunable oscillator turnable to said carrier and having an input to receive an error signal and an output providing an oscillating current whose frequency varies with the values of said error signal;

means providing said oscillating current to said plurality of control conductors as a control current;

detecting circuit means coupled to said antenna winding for receiving the modulated carrier and detecting the information modulated thereon; and phase comparator means having inputs coupled to said tunable oscillator and to said helical antenna winding and an output providing said error signal as a function of any phase difference between said control current and the received modulated carrier.

12. A magnetic dipole antenna comprising an elongated magnetic core having a plurality of bores extending axially therethrough, a helical winding about a central portion of said core and having an axial length substantially less than the length of said elongated magnetic core; disposed for generating a normal magnetic field generally in the axial direction of said core; and a control winding formed of conductors passing through said bores in said magnetic core for creating a control field substantially orthogonal to the normal field of said helical winding.

13. A magnetic dipole antenna comprising an elongated magnetic core assembly formed of a plurality of $N_x$ core rods arranged in a bundle of hexagonal cross section, where $$N_x = 1 + \sum_{n=1}^{x} 6_n,$$

and x is a positive integer, and each said core rod is formed of a stack of toroidal members defining an axial bore extending through the respective rod so formed; a helical antenna winding circumferentially about a central portion of said elongated magnetic core assembly and having an axial length substantially smaller than the axial dimension of said core assembly; and a control winding within said core assembly and formed of conductors passing through at least certain ones of the axial bores of said core rods to create a control magnetic field substantially orthogonal to the axial direction of said core assembly.

14. A magnetic dipole antenna according to claim 13, wherein said toroidal members include ferrite cups having a circumferential wall defining a space therewithin and an end wall having a central aperture such that the central apertures of the ferrite cups of each stack define said axial bore.

15. A magnetic dipole antenna comprising a plurality of ferrite rods forming a bundle such that central axes of the rods are parallel, with each rod having an axial bore therethrough; a helical antenna winding circumferentially about said bundle of rods; a control winding within said bundle of rods including a plurality of conductors each passing through the axial bore of a respective rod; with spaces formed between said rods to provide axial passages through which a cooling fluid can be circulated for removing waste heat generated by control current flowing in said control winding.

* * * * *